US010415315B2

(12) United States Patent
Madsen

(10) Patent No.: US 10,415,315 B2
(45) Date of Patent: Sep. 17, 2019

(54) ARCTIC DRILLING PROCESS

(71) Applicant: MAERSK DRILLING A/S, Kgs. Lyngby (DK)

(72) Inventor: Jens Jørgen Madsen, Holte (DK)

(73) Assignee: MAERSK DRILLING A/S., Kgs. Lyngby (DK)

( * ) Notice: Subject to any disclaimer, the term of this patent is extended or adjusted under 35 U.S.C. 154(b) by 0 days.

(21) Appl. No.: 15/578,065

(22) PCT Filed: May 30, 2016

(86) PCT No.: PCT/DK2016/000024

§ 371 (c)(1),
(2) Date: Nov. 29, 2017

(87) PCT Pub. No.: WO2016/192729

PCT Pub. Date: Dec. 8, 2016

(65) Prior Publication Data

US 2018/0155987 A1 Jun. 7, 2018

(30) Foreign Application Priority Data

May 29, 2015 (DK) ..... 2015 00315
Jun. 11, 2015 (DK) ..... 2015 00338

(51) Int. Cl.
*E21B 7/12* (2006.01)
*B63B 21/50* (2006.01)
(Continued)

(52) U.S. Cl.
CPC ..... *E21B 7/12* (2013.01); *B63B 21/507* (2013.01); *B63B 35/4413* (2013.01);
(Continued)

(58) Field of Classification Search
CPC ... B63B 21/507; B63B 2211/06; E21B 15/02; E21B 33/064; E21B 33/14; E21B 7/12
See application file for complete search history.

(56) References Cited

U.S. PATENT DOCUMENTS 3,837,311 A 9/1974 Lea
4,295,758 A 10/1981 Yashima
(Continued)

FOREIGN PATENT DOCUMENTS

WO WO 02/088516 A1 11/2002
WO WO 2008/140654 A1 11/2008
(Continued)

OTHER PUBLICATIONS

Danish Patent Application No. PA 2015 00338; Search Report completed Jan. 5, 2016 (4 pages).
(Continued)

*Primary Examiner* — James G Sayre
(74) *Attorney, Agent, or Firm* — Lathrop Gage LLP

(57) ABSTRACT

A process for drilling a well into the seafloor at an offshore drilling location, in particular in arctic regions, the process comprising: drilling a top hole part of the well during a winter season where the water at the drilling location is at least partly covered by ice; and initiating drilling a lower part of the well extending into a hydrocarbon-bearing formation during a subsequent off-winter season where the water is less ice infested than during the winter season.

38 Claims, 4 Drawing Sheets

(51) Int. Cl.

| | |
|---|---|
| ***B63B 35/44*** | (2006.01) |
| ***E21B 15/02*** | (2006.01) |
| ***E21B 33/14*** | (2006.01) |
| ***E21B 33/064*** | (2006.01) |

(52) U.S. Cl.
CPC ..... *E21B 15/02* (2013.01); *E21B 33/064* (2013.01); *B63B 2211/06* (2013.01); *E21B 33/14* (2013.01)

(56) References Cited

U.S. PATENT DOCUMENTS

| | | | |
|---|---|---|---|
| 4,434,741 | A | 3/1984 | Wright et al. |
| 2011/0188938 | A1 | 8/2011 | Nedwed et al. |
| 2011/0247827 | A1 | 10/2011 | Humphreys |
| 2013/0183876 | A1 | 7/2013 | Veselis et al. |
| 2015/0284054 | A1* | 10/2015 | Kokkinis ..... B63B 21/508 441/3 |

FOREIGN PATENT DOCUMENTS

| | | | |
|---|---|---|---|
| WO | WO 2009/099337 | A1 | 8/2009 |
| WO | WO 2012/054891 | A1 | 4/2012 |
| WO | WO 2014/099269 | A1 | 6/2014 |

OTHER PUBLICATIONS

International Patent Application No. PCT/DK2016/000024; International Search Report and Written Opinion dated Sep. 5, 2016 (9 pages).
Danish Patent Application No. PA 2017 00747; Search Report dated Mar. 29, 2019; 4 pgs.

* cited by examiner

ARCTIC DRILLING PROCESS

CROSS REFERENCE TO RELATED APPLICATIONS

The present application is a 35 U.S.C. § 371 filing of International Application No. PCT/DK2016/000024, filed 30 May 2016, which claims priority to Danish Patent Application No. PA 2015 00315 filed 29 May 2015 and Danish Patent Application No. PA 2015 00338 filed 11 Jun. 2015, the entire contents of which are incorporated herein by reference.

TECHNICAL FIELD

The present invention relates to an offshore drilling process for drilling holes into the seafloor in Arctic offshore regions.

Arctic offshore regions include vast oil-bearing regions that still have to be recovered. Such regions include the Beaufort Sea and other regions around the Arctic Circle. One of the challenges related to the performance of drilling operations in Arctic offshore regions includes seasonal limitations on the drilling activities. In many regions, drilling into oil-bearing formations is limited to the seasons when the water is not covered by ice, as oil spill containment and oil recovery after a potential incident resulting in a sub-sea oil spill is considerably more difficult in ice-infested waters.

Nevertheless, several approaches for protecting drilling vessels against ice and for ice management have been developed so as to enable drilling equipment to be operable even during the winter season.

For example, US 2011/0188938 relates to the field of offshore operations in Arctic conditions. More specifically, this prior art document relates to the break-up of ice masses in Arctic waters to prevent a collision of such ice masses with an offshore operations facility.

Bottom-founded platforms have been developed for shallower water. In deeper water such as in water depth of 75 m or greater, however, bottom-founded platforms become impractical, and floating platforms may be employed. For example, a ship-shaped vessel is attractive as a floating platform in cold environment and areas with drifting ice because it has a large deck area, it has a large under-deck volume, and ice loads on it from drifting ice are relatively low when the vessel is aligned with the ice drift direction. Such floating platforms may keep station with the help of a mooring system comprising several anchor lines connected to the vessel preferably below the water line to avoid entanglement with ice, e.g. by means of a turret at the bottom of the hull of the vessel through which drilling operations are performed. When the anchor lines are attached to a turret, the vessel may shift heading or rotate in the ice so as to allow the vessel to be aligned with changing ice drift directions (ice-vane).

In view of the challenges related to drilling operations in ice infested waters and despite considerable advances achieved so far in terms of suitable equipment, it would still be desirable to provide an efficient yet safe drilling process suitable for artic offshore regions.

Disclosed herein are embodiments of a process for drilling a well into the seafloor at an offshore drilling location, in particular in Arctic regions, the process comprising:

drilling a top hole part of the well during a winter season where the water at the drilling location is at least partly covered by ice;

initiating drilling a lower part of the well extending into a hydrocarbon-bearing formation during a subsequent off-winter season where the water is less ice infested than during the winter season.

Hence, as the drilling of the top hole part may be performed with little or no risk of hydrocarbons, such as oil, from the reservoir spilling into the environment, this part of the drilling process may be performed during the winter season where the water is at least partly covered by ice.

Once the weather conditions improve during the subsequent off-winter season, i.e. a subsequent spring and/or summer and/or fall season, the drilling operations may be continued by drilling deeper into the formation and, in particular, into the hydrocarbon-bearing formations that contain a hydrocarbon reservoir such as oil and/or gas. Hence, the lower part of the well refers to a part of the well that is deeper than the top hole part. While the subsequent off-winter season may be the season directly following the winter season during which the top hole part was drilled, it will be appreciated that the subsequent off-winter season may also be a later season and, in some instances, even an off-winter season of a subsequent year. Moreover, it will be appreciated that the drilling of the lower part of the well is initiated but does not necessarily need to be completed during a single off-winter season subsequent to the winter season during which the top hole part of the well has been drilled; the process may stretch over several seasons, e.g. off-winter seasons of more than one year.

Generally, during the winter season, the water surface may be completely or partially covered by ice (typically originating from the sea but may also have land based origin such as from glaciers) which may be more or less stationary or it may drift at varying degrees. Drifting ice may have a variety of forms, such as ice floes of varying sizes, it may be level ice, comprise ridges etc. and have various origins such as the sea and glaciers. The drifting ice may be managed or unmanaged ice, i.e. the drifting ice may or may not have already been managed by e.g. one or more vessels with icebreaking capacities before reaching the vessel.

The beginning and the end of the winter season may depend on a variety of factors and differ from region to region and/or from year to year. In some regions national or international regulations may prohibit the drilling into hydrocarbon-bearing foundations during a specified period. Hence, the winter season may be defined as the period during a calendar year where drilling into hydrocarbon-bearing formations is prohibited due to the presence of ice. In some embodiments the winter season may be defined as the period from 1 November of a calendar year until 1 July of the subsequent calendar year. In some embodiments, the start of the winter season may be earlier, e.g. no earlier than 1 October, or the start of the winter season may be later, e.g. no earlier than 1 December. Similarly, the end of the winter season may be earlier than 1 April, e.g. no earlier than 1 March, 1 May, e.g. no earlier than 1 April, 1 June, e.g. no earlier than 1 May, 1 July, e.g. no earlier than 1 June, or later than 1 July, e.g. no earlier than 1 August or no earlier than 1 September. In some embodiments, the winter season may be defined based on the typical ice concentration and/or the typical ice thickness at the drilling location, e.g. as expressed as an average ice concentration and/or an average ice thickness measured or estimated over a period of several years, such as the most recent 5-year period. The winter season may thus be defined by the period of the calendar year where the typical or current ice concentration at the drilling location is at least 3/10 or higher, such as 5/10 or higher, such as 7/10 or higher, e.g. 8/10 or higher, such as 9/10 or higher and/or as the period of the calendar year where the typical or current ice thickness exceeds a predetermined threshold, e.g. 0.1 m, such as 0.3 m, such as 0.5 m, such as 1 m, such as 2 m. The ice concentration is expressed in tenths describing the amount of the sea surface covered by ice as a fraction of the whole area being considered.

The subsequent off-winter season where drilling into the lower part of the well may be initiated may be defined as a season outside the winter season where the beginning of the off-winter season may be defined as the point in time when the current and/or the typical ice concentration reaches a level below a predetermined threshold, e.g. an ice concentration below 4/10, such as below 3/10 such as below 2/10, such as below 1/10. Accordingly, in some embodiments, the off-winter season may be an open-water season where the ice concentration in the region of the drilling location is below 4/10, such as below 3/10 such as below 2/10, such as below 1/10, such as below 0.1/10, such as 0.

The top hole part of the well may comprise the part of the drilled hole that only extends through formations above any hydrocarbon-bearing formation from which hydrocarbons may rise through the drilled hole. Drilling operations into hydrocarbon-bearing formations normally require the deployment of a blow-out-preventer (BOP) system where deployment of the BOP refers to the process of installing the BOP in its operational position and state such that subsequent drilling operations that are performed after the deployment of the BOP are performed through the BOP. Depending on the type of drilling vessel, such BOP systems may be deployed at the seafloor or above water, e.g. on or directly under the drilling platform. A BOP system deployed at the seafloor may be lowered on top of the seafloor after drilling the top hole part of the well. Alternatively, the BOP may be lowered into a cavity that is established at the seafloor. Such a cavity is also referred to as a mud-line cellar or a caisson when the cavity is supported by surrounding structure. In any event, after deployment of the BOP, further drilling operations are then performed through the BOP and through a riser string. When the BOP is deployed at the seafloor, the riser string extends between the BOP to the drilling vessel. The top hole part of the well may in some embodiments be defined as the part of the well that is drilled prior to deployment of the blow-out-preventer.

The top hole may comprise an uppermost part, e.g. formed by a 36" conductor or by a conductor of another suitable diameter. The top hole may comprise a lower top hole portion into which a casing, e.g. a 22" casing or a casing having another suitable diameter, may be inserted and cemented. Drilling the top hole part may thus comprise completing the top hole part of the well by inserting a conductor and/or one or more casings (such as 2 or more casings) and optionally cementing at least the casing and optionally the conductor. However, in some embodiments the top hole section is a drilled well construction (that may become a well once the lower sections are drilled into a reservoir) having 3 casing sections or less (e.g. casing sections with different diameter sizes), such as 2 or less, such as 1. While the foregoing has been described in relation to typical well construction technologies of conductor and casings, the skilled person will appreciate that the invention also applies alternative or future well construction methods. For example, it may be possible to safely construct the top hole using one or more liners (a pipe hung off the lower end of the preceeding pipe) as an alternative to casing and/or collapsible types of pipe where the diameter of subsequent section may be made substantially similar because the one section can be inserted through the other in a collapsed form and then expanded.

The depth of the top hole part that is drilled during the winter season may depend on the depth at which the hydrocarbon-bearing formation is located. In some embodiments the top hole part may extend more than 500 feet such as more than 1000 feet, such as more than 1500 feet into the seafloor as measured from the drill floor of the drilling vessel.

The drilling operation during the winter season may be performed by any suitable drilling vessel suitably adapted for operation in ice infested or ice covered waters. Similarly, the drilling operations during the subsequent off-winter season may be performed by any suitable drilling vessel suitably adapted for operation in the offshore region in question. In some embodiments, the continuation of the drilling operation during the off-winter season is performed by the same drilling vessel as the one that has performed the drilling of the top hole part. Hence a drilling vessel may be kept within the same region while being able to operate not only during the off-winter season.

After completing the drilling of the top hole part, the vessel may leave the drilling location. The same or a different drilling vessel may then return to the drilling location during the subsequent off-winter season for initiating drilling the lower part of the hole. To this end, the process may comprise covering the drilled top hole part by a removable cover so as to protect the integrity of the drilled hole until the drilling operations are resumed during the off-winter season. The term drilling location is intended to refer to the geographical location of the well. When referring to a position of a drilling vessel at the drilling location or to a position at the water surface at the drilling location, reference is made to the position at the sea surface, generally above the position of the well, from which a vessel is operable to perform drilling operations into the well.

The drilling vessel may be a drillship, a floating drilling platform or another type of floating vessel or a bottom supported platform such as as a jack-up platform or a gravity based platform for the exploration of hydrocarbons, such as oil or gas. The drilling vessel may be ship-shaped or have a different shape. In some embodiments, the drilling vessel may be a mobile bottom-supported vessel, such as a jack-up platform.

The drilling vessel may have a moon pool or other opening through which equipment is lowered towards the seafloor, e.g. drill pipe, casing or a drilling riser extending from the vessel towards the seafloor. Other examples of such equipment include a wellhead, a lower marine riser package and a BOP.

The drilling vessel may comprise a mooring system such as a turret mooring system. In some embodiments, the mooring system comprises a number of anchor lines operable to keep the vessel on station. A turret mooring system may further comprise: a turret column or other turret structure operable to connect the anchor lines to the vessel; a bearing arrangement operable to allow the vessel to weather vane; and a support structure operable to support the bearing arrangement. The anchor lines are thus connected to the turret structure that is rotatable relative to the vessel.

The moonpool and the turret system define a downward axis around which the turret is rotatably arranged relative to the hull of the vessel. Hence, during operation, when the turret structure is secured to the seafloor by means of the anchor lines, the vessel may pivot around the axis, while the turret may remain substantially geostatic. The anchor lines may be connected to the turret column or another component of the turret structure such as a chaintable that is connected to the lower end of the turret column; the anchor lines may extend from respective anchor sites distributed around the periphery of the opening.

In some embodiments, the method comprises drilling respective top hole parts of a plurality of wells at respective drilling locations by a drilling vessel during the same winter season; and initiating drilling respective lower parts of one or more of said wells during a subsequent off-winter season where the water at the respective drilling locations is less ice infested than during the winter season; wherein the respective lower parts extend into a hydrocarbon-bearing formation.

To this end, the drilling vessel may be moored at a first drilling location so as to allow drilling of the top hole part of a first well at the first drilling location during the winter season. The drilling vessel may then be moved to and moored at a second drilling location so as to allow drilling of the top hole part of a second well at the second drilling location during said winter season. In particular, the drilling vessel may be moored by a plurality of anchor lines extending from the vessel to respective anchor sites located at the seafloor.

To this end, the process may comprise disconnecting one, some, or even all anchor lines at the first location, moving the drilling vessel to the second location and connecting one or more anchor lines at the second location. In some embodiments, e.g. when the wells are close to each other, the movement of the vessel between drilling locations may not necessarily require any or at least not all anchor lines to be disconnected from the vessel or from the anchor site, as some or all of the same anchor sites may still be used. It may thus be sufficient to adapt the length of some or more of the anchor lines so as to position the vessel at the second drilling location.

As the process of disconnecting and re-connecting anchor lines is a time consuming process it is generally desirable to reduce the time for re-positioning the drilling vessel between the first and second drilling locations.

Drilling operations through a marine riser and a BOP require the vessel to be maintained stationary above the well, e.g. such that the line connecting the BOP and the well center of the drill floor of the vessel does not deviate from the vertical more than 10°, such as no more than 8°, such as no more than 6°. A larger deviation may be acceptable when drilling the top hole part without employing a marine riser. For example, when drilling the top hole part, a deviation of up to 25° may be acceptable, such as up to 22°, such as up to 20°. Hence, when drilling the top hole part, fewer anchor lines may suffice while still being able to maintain the vessel stationary within acceptable tolerances. In some embodiments, the drilling vessel may use a dynamic station keeping system in addition to anchor lines when drilling the top hole part, so as to be able to further reduce the number of required anchor lines.

To this end the process may comprise mooring the drilling vessel at the first drilling location prior to the drilling of the top hole part of the first well using a first number of anchor lines. During the subsequent off-winter season, the drilling vessel may again be moored (i.e. remain moored or be re-moored) at the first drilling location using a second number of anchor lines so as to drill the lower part of the well and, in particular, to drill through a blow-out-preventer and through a marine riser; wherein the first number of anchor lines is smaller than the second number of anchor lines. For example, during the drilling of the top hole part of the well during winter season, only 70% or fewer anchor lines may be used as compared to the number of anchor lines used during the subsequent drilling of the lower part of the well, such as 60% or fewer, such as 50% or fewer, such 40% of fewer, such as 30% or fewer anchor lines. For example, during drilling of the top hole part of the well, the drilling vessel may be moored by no more than 12 anchor lines, such as no more than 10 anchor lines, such as no more than 8 anchor lines. In one example, when drilling the lower part of the well, in particular when drilling with a blow-out-preventer and through a marine riser, the drilling vessel may be moored using 16 anchor lines, while the drilling vessel is only moored using 8 anchor lines when drilling the top hole part of the well.

When drilling a plurality of top holes, the anchor lines at some or all drilling locations may be laid out prior to arrival of the drilling vessel at the respective drilling location, optionally even during an off-winter season prior to the winter season during which the top hole parts are drilled. To this end, the anchor lines may be laid out by a vessel different from the drilling vessel, e.g. by an anchor handling vessel or a supply vessel with anchor handling facilities. The method may comprise pre-deploying one or more anchor lines at one or more drilling locations prior to arrival of the drilling vessel. The pre-deployed anchor line may then be efficiently recovered upon arrival of the drilling vessel. For example, the anchor lines may have a lead line connected to them that can be picked up by a hook, a remotely operated underwater vehicle (ROV) or the like. To this end, the lead may be connected to a buoy or other floatation device so that it floats above the seafloor, e.g. below the ice.

Each anchor line has a bottom end configured to be secured at the seafloor at an anchor site, and an upper end configured to be connected to the drilling vessel. In some embodiments, the respective upper ends of two or more pre-deployed anchor lines may be connected to a connecting member so as to allow the connecting member to be raised and connected to the drilling vessel. Hence multiple anchor lines may concurrently be attached to the vessel in an efficient manner.

The connecting member may have any suitable shape. In some embodiments, the connecting member may be ring-shaped or have the shape of a ring segment, e.g. such that multiple connecting members, each having a number of anchor lines attached to it, may be connected to the vessel, e.g. to a turret structure, so as to form a ring around the moonpool. When the connecting member is ring-shaped it is even possible to connect the upper ends of all anchor lines to a single ring-shaped connecting member which may then be raised and connected to the vessel, e.g. to the turret structure, such that the ring surrounds the moon pool. In particular, an efficient mounting of multiple anchor lines connected to a connecting member may be beneficial when drilling top hole parts of multiple wells, as the drilling of the top hole parts does not involve a BOP or marine riser below the vessel which could be damaged in case the anchor lines and the connecting member have to be disconnected from the vessel.

The present disclosure relates to different aspects including the drilling process described above and in the following, and to corresponding systems and/or products. Each aspect may yield one or more of the benefits and advantages described in connection with one or more of the other aspects, and each aspect may have one or more embodiments with all or just some of the features corresponding to the embodiments described in connection with one or more of the other aspects and/or disclosed in the appended claims.

BRIEF DESCRIPTION OF THE DRAWINGS

In the following, one or more embodiments of the invention will be described in more detail and with reference to the drawings, where.

DESCRIPTION OF THE EMBODIMENTS

Figure 1:
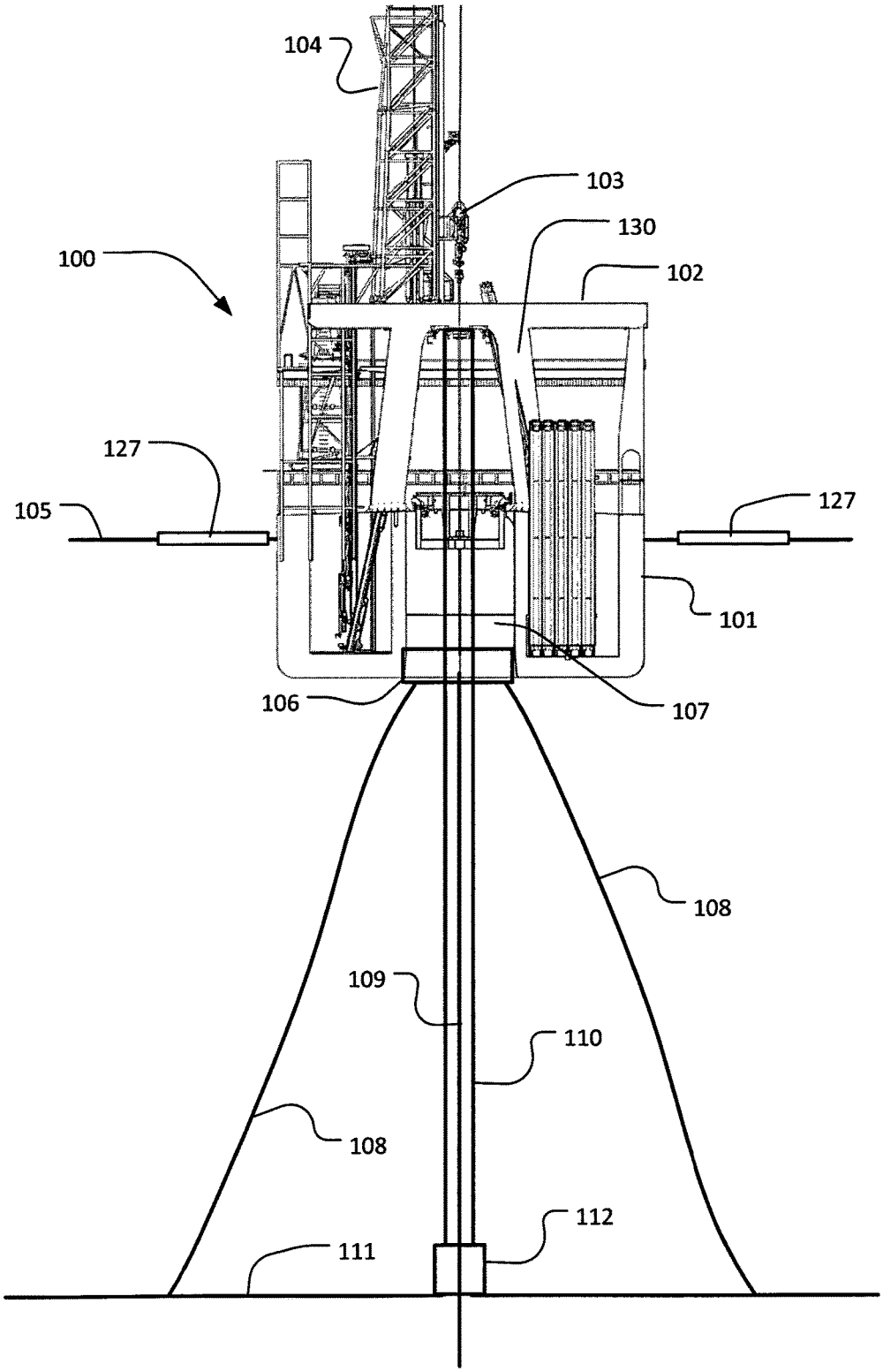
FIG. 1 schematically shows an example of a cross section of a marine vessel.

FIG. 1 schematically shows an example of a drilling vessel floating in a body of water 105 with drifting ice 127. In particular, FIG. 1 shows a cross section of a drillship, generally designated 100, that is anchored to the seafloor 111 by anchor lines 108. The drillship comprises a hull 101 which may be substantially oblong or ship-shaped; alternatively the drilling vessel may have a different shape, e.g. an off-shore platform. The drillship further comprises a drill floor 102 formed on top of a platform supported by legs 130 or another form of substructure. The platform defines the drill floor from which drilling operations are conducted and spans across a moon pool 107 formed in the hull of the drillship so as to allow equipment to be lowered towards the seafloor. One or more holes in the drill floor, each typically in the form of a rotary table, define one or more well centres through which drilling operations can be performed. The well centre(s) may be located next to or generally under a drilling support structure 104 supporting a hoisting system. In the example of FIG. 1, the drilling support structure is a mast positioned adjacent to the well centre, but other forms of drilling support structures, such as a derrick structure placed over the well centre, are possible as well. The drilling support structure is supported by the legs 130 or a similar substructure and it extends upwardly relative to the drill floor 102. The hoisting system comprises a hook or similar device from which a string of tubulars 109 may be suspended and lowered and raised through the well centre and the moon pool 107. To this end, the hoisting system may comprise a topdrive 103 to which an upper end of the drill string may be connected and which may impart torque on the drill string. The hoisting system may be a draw-works system where the hoisting line is fed over stationary sheaves carried by the drilling support structure or another suitable type of hoisting system such as a hydraulic hoisting system comprising cylinders that extend upwardly from the drill floor and support the load to be lowered or hoisted.

The drillship is configured to perform drilling operations without a marine riser or through a marine riser string 110 extending from the drillship to a BOP 112 that is placed on the seafloor. Hence, the drillship is connectable to a subsea well via the marine riser string 110. The drillship is moored via a turret 106 and a plurality of anchor lines 108. The turret allows the drill ship to align its longitudinal axis with any given ice drift direction, a direction of a local sea current, a wind direction, and/or the like. To this end, the ship may rotate around the vertical axis defined by the turret 106. The marine riser may be located coaxial with the axis of rotation.

In general, floating drilling units, such as drillships and semi-submersibles, are frequently used for drilling operations for exploration of hydrocarbon reservoirs, such as oil or natural gas reservoirs, in subsea formations, for establishing bored wells into such reservoirs and/or for subsequent production of hydrocarbons. It will be appreciated that the size and shape of the vessel, its equipment, and/or the type of equipment extending downwards from the vessel may vary according to the specific application.

When the drillship floats in drifting ice 127 the drillship is typically oriented such that the ice approaches the bow of the hull 101. To this end, embodiments of the hull may have an ice-breaking shape and sufficient strength so as to break the ice. Generally, the hull may comprise one or more features (not explicitly shown) that are shaped and sized so as to prevent ice from submerging below the bottom of the hull. In some embodiments, such features may extend along the bow and/or the sides of the midship section of the hull. The hull may comprise a generally flat bottom, though other hull shapes are possible including hulls having an inclined bottom.

Figure 2A:
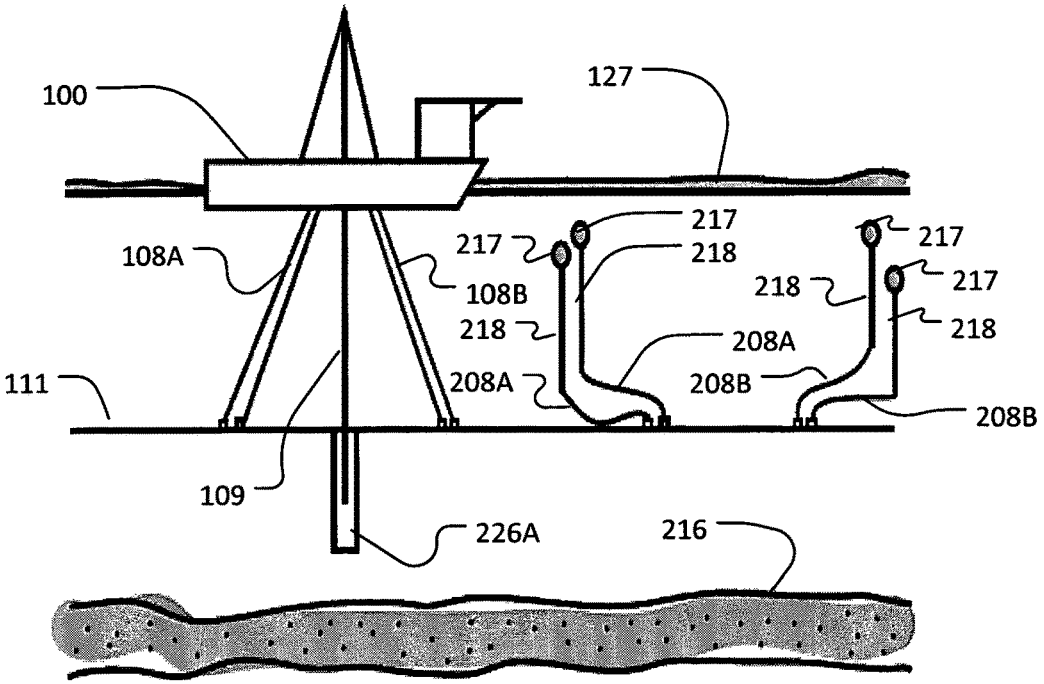
FIGS. 2A-D schematically illustrate an embodiment of a drilling process.

FIGS. 2A-D schematically illustrate an embodiment of a drilling process. In particular, FIG. 2A shows a drilling vessel 100 positioned and moored at a first drilling location where the subsea formations under the seafloor comprise an oil-bearing formation 216. In the example of FIGS. 2A-D, the drilling vessel is a drillship, e.g. a drillship as described in connection with FIG. 1. The drilling vessel 100 is moored to the seafloor 111 by means of anchor lines 108A and 108B. The anchor lines have a lower end anchored at the seafloor and an upper end attached to the vessel, e.g. to a turret structure as described in connection with FIG. 1. The drilling vessel 100 of FIG. 2A is in the process of drilling a top hole part of a first well 226A, i.e. a part of the well that does not extend into the oil-bearing formation 216. To this end, the drilling vessel drills a hole using a drill string 109 of a suitable diameter, such as 22" or more, such as 36" or more. Drilling the top hole part of the well may include inserting a conductor pipe into the upper part of the top hole, whereafter drilling of a lower part of the top hole continues through the conductor, i.e. where the lower part of the top hole has a smaller diameter than the upper part. A casing pipe may then be inserted into the lower part of the top hole and secured by injecting cement into the annulus surrounding the casing. Drilling the top hole part may further comprise tasks in preparation for the deployment of a blow-out-preventer, e.g. the establishment of a mud cellar or caisson, e.g. as described in U.S. Pat. No. 4,558,744, so as to allow deployment of the BOP into a recess or cavity in the seafloor, e.g. so as to protect the BOP against passing icebergs. Upon completion of the top hole part, a lid or similar cover may be placed on the top hole, so as to protect the top hole during the period until the drilling operations may be resumed during a subsequent off-winter season.

As the drilling of the top hole part of the well 226A does not involve drilling into the oil-bearing formation 216, this part of the drilling operation may safely be performed during the winter season when the sea surface is completely or partially covered by ice 127.

Typically, during exploration of an oil field, multiple wells are drilled into the oil-bearing formations 216. Accordingly, it may be desirable to drill, e.g. by a single drilling vessel, top holes of multiple wells within the same Arctic region during a winter season and to continue the drilling of one or more of these wells during a subsequent off-winter season, e.g. using the same drilling vessel. To this end, the process may comprise laying out anchor lines 208A and 208B at a second drilling location before drilling the top hole of the first well 226A at a first drilling location has been completed. The deployment of the anchor lines may e.g. be performed by a supply vessel different from the drilling vessel 100. This is schematically illustrated in FIG. 2A, showing pre-deployed anchor lines 208A and 208B. The predeployed anchor lines may then be picked up again by the drilling vessel or by a supply vessel. For example, the anchor lines 208A, 208B may have lead cables 218 connected to them that can be picked up by a hook, an ROV or the like. To this end, the lead may be connected to a buoy 217 or other floatation device so that it floats above the seafloor, e.g. below the ice 127.

Figure 2B:
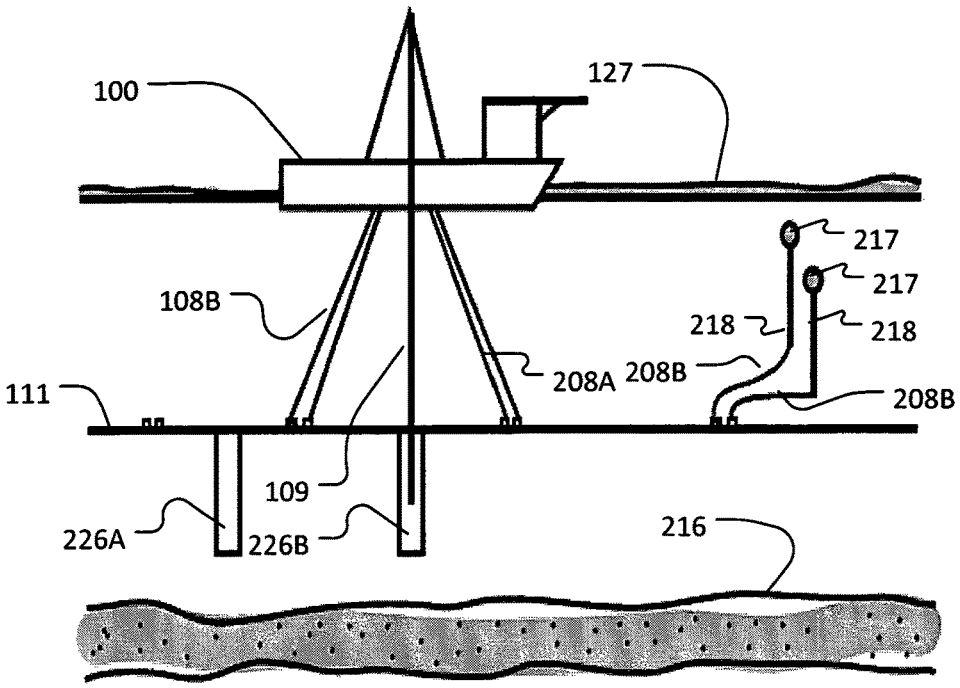

FIG. 2B shows the drilling vessel 100 after it has completed drilling the top hole part of the first well and has been repositioned to a second drilling location so as to be able to drill the top hole part of a second well 226B. To this end, some anchor lines 108A that were used for mooring the vessel at the first drilling location have been disconnected and, after repositioning the vessel, pre-deployed anchor lines 208A have been recovered and connected to the drilling vessel 100 so as to keep the vessel at the second drilling location. Hence, in some situations, some, or even all, anchor lines used for mooring the vessel at the first drilling location may be re-used for mooring the vessel at the second drilling location without a need for complete recovery and redeployment of the anchor lines. The extent to which this is advantageous may depend on the specific circumstances, e.g. on the distance between the wells. Under some circumstances, it may be beneficial or even necessary to disconnect all anchor lines at the first location and to reconnect an entire set of anchor lines at the second drilling location. In other situations, it may be possible to leave all anchor lines connected to the vessel and to merely adjust their lengths so as to secure the vessel at the second drilling location.

Figure 2C:
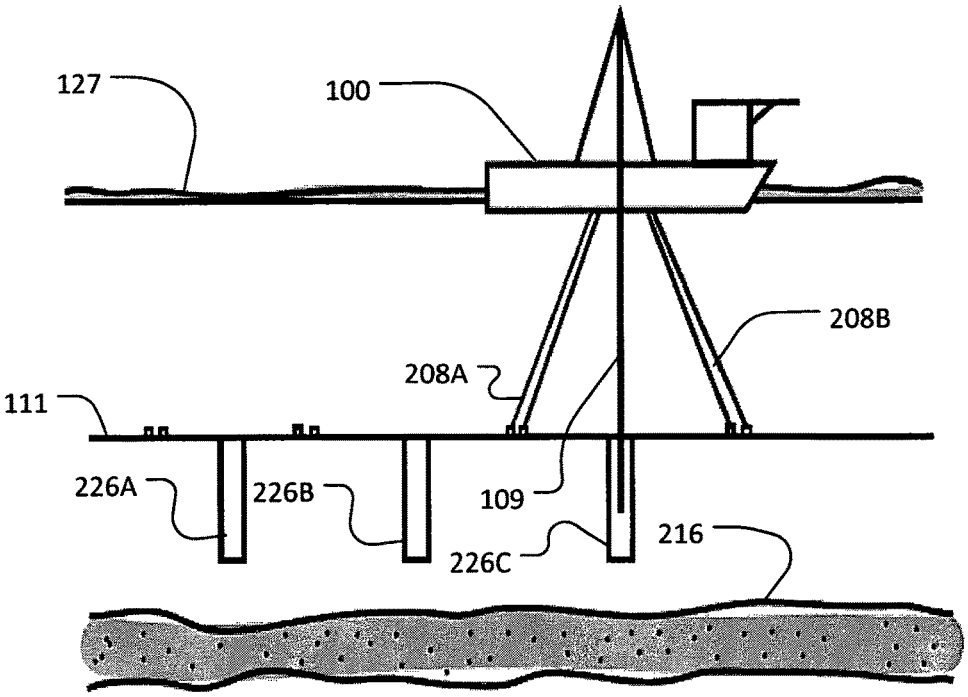

FIG. 2C shows the drilling vessel after it has completed drilling the top hole part of the second well 226B, repositioned and moored at a third drilling location by anchor lines 208A and 208B and in the process of drilling the top hole part of a third well 226C. Hence, during a single winter season the top hole part of one well or of multiple wells may be drilled in an efficient and safe manner by a single drilling vessel.

During a subsequent off-winter season, where the water surface 105 is sufficiently free of ice, the drilling vessel 100 may resume drilling operations at one or more of the wells where the top hole part has previously been established.

Figure 2D:
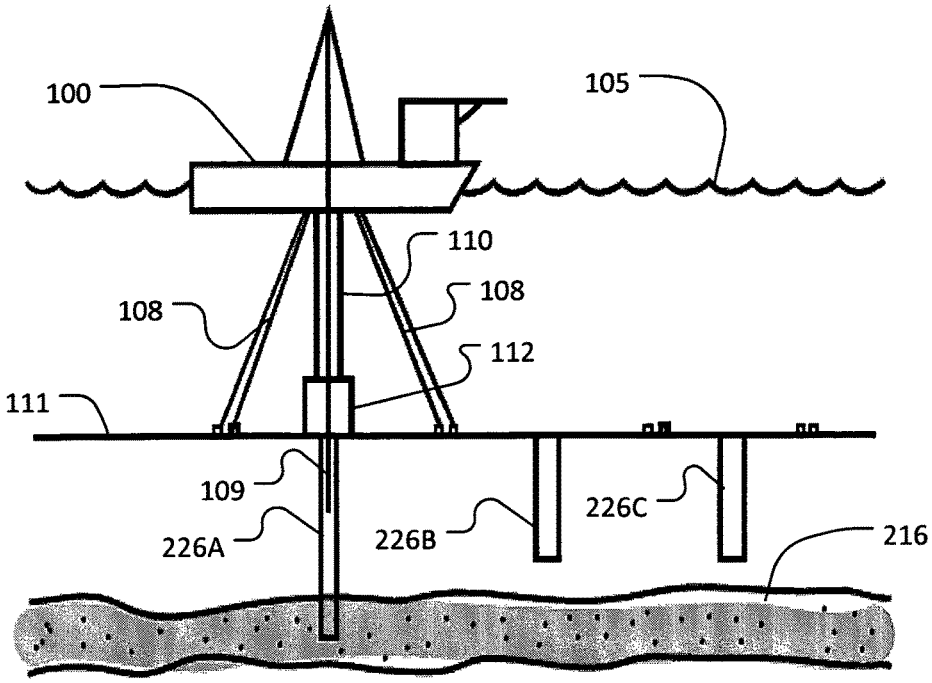

To this end, as illustrated in FIG. 2D, the vessel is again moored at the corresponding well 226A. It will be appreciated that, if the vessel continues drilling operations of the latest established top hole, a re-mooring may not be necessary, as the drilling vessel may simply remain at the corresponding drilling location. Hence, for the purpose of the present disclosure, reference to a vessel being again moored refers both to the situation where the vessel remains moored and where the vessel is un-moored and subsequently re-moored at the same location. In any event, in order to be able to drill into the oil-bearing formation 216, the drilling vessel deploys a BOP 112 and a riser 110. In the case of floating vessels, the BOP 112 is typically deployed at the seafloor, as illustrated in FIG. 2D—optionally in a mud cellar or caisson. In this case a marine riser 110 extends between the vessel and the BOP. In any event, the further drilling operations into the deeper oil-bearing formations 216, i.e. deeper than the top hole part that was drilled prior to deployment of the BOP, are performed with the drill string 109 extending through the riser 110 and the BOP 112.

Figure 3A:
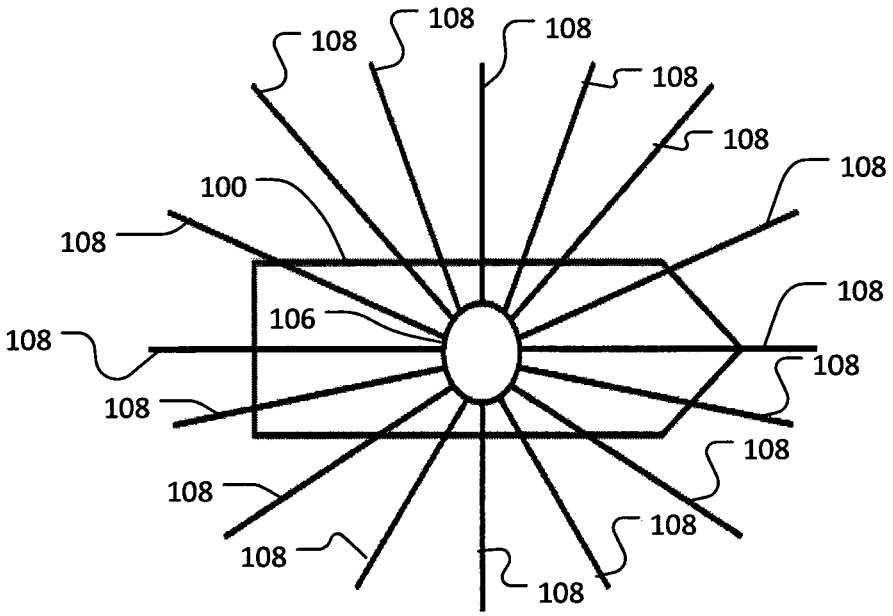
FIGS. 3A-B schematically illustrate an example of the mooring of a drilling vessel during drilling through a marine riser and while drilling a top hole, respectively.
Figure 3B:
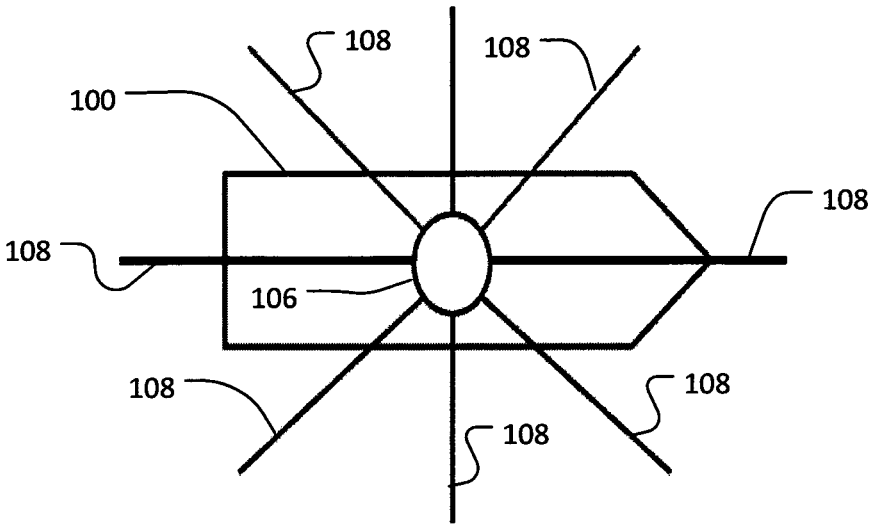

FIGS. 3A-B schematically illustrate an example of the mooring of a drilling vessel during drilling through a marine riser and while drilling a top hole, respectively. Drilling operations through a riser and the BOP impose stricter requirements on the station keeping of the vessel as the initial drilling of the top hole part that has a relatively larger diameter. In particular, the riser is made up of large-diameter tubular members that extend through the moon pool of the vessel downwards. Large horizontal displacements of the vessel relative to the well centre may cause the riser to impact the walls of the moon pool or the turret, thus involving the risk of damaging parts of the vessel or of the riser.

Accordingly, during the drilling of the top hole part of a well during winter season, it may be sufficient to moore the vessel using fewer anchor lines than during the further drilling operations through the riser and the BOP during a subsequent off-winter season. This is schematically illustrated in FIGS. 3A-B. FIG. 3A shows the vessel 100 being moored using 16 anchor lines 108 attached to the turret structure 106 of the vessel. FIG. 3B shows the same vessel being moored during the drilling of the top hole part of a well during the winter season, where the vessel is moored by only 8 anchor lines 108. The fewer anchor lines thus allow for a faster repositioning and re-mooring of the vessel at multiple drilling locations during a winter season.

It will be appreciated that, during the winter and/or the off-winter season, the vessel may be moored using a different number of anchor lines as shown in the example of FIGS. 3A-B, as the exact number of lines may depend on a variety of factors, such as water depths, nature of the seafloor, sea currents, wind conditions, ice drift, etc.

In order to allow for an even more efficient re-mooring of the vessel during the winter season, some or all of the anchor lines may, prior to or upon deployment, be attached to a connecting member that may be removably attachable to the vessel, e.g. to the turret structure of the vessel. For example, the connecting member may be ring-shaped or have the shape of a ring segment. The diameter of the ring or ring segment may correspond to the dimensions of the turret. When the vessel is positioned at a drilling location, multiple anchor lines may thus be recovered and attached to the vessel in a single efficient process. For example, the connecting member may be formed as a disconnectable rotatable part of a turret moorig system, e.g. as described in U.S. Pat. No. 8,397,655.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention. In particular, embodiments of the drilling process have mainly been described with reference to a turret mooring system. However, it will be appreciated that embodiments of the process described herein may also be used in connection with other types of positioning systems.

The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A process for drilling a well into a hydrocarbon-bearing formation below the seafloor at an offshore drilling location, the process comprising:

from a drilling vessel, drilling a top hole part of the well during a winter season to a depth above the hydrocarbon-bearing formation during a time when water at the drilling location is at least partly covered by ice;

interrupting the drilling at the depth to reduce risk of hydrocarbons spilling into the water while the water is at least partly covered by ice;

resuming drilling into a lower part of the well from the depth and extending into the hydrocarbon-bearing formation during a subsequent off-winter season where the water is less ice-infested than during the winter season; and deploying a blow-out preventer at the drilling location between the steps of drilling a top hole part of the well and resuming drilling into a lower part of the well.

2. The process according to claim 1, further comprising inserting one or both of a casing and conductor into the top hole part after or during the step of drilling the top hole part but before the step of interrupting.

3. The process according to claim 2, further comprising cementing one or both of the casing and conductor in the top hole part of the well.

4. The process according to claim 2, further comprising completing the drilling of the lower part during the subsequent off-winter season.

5. The process according to claim 1, wherein drilling the top hole part comprises drilling through the blow-out preventer.

6. The process according to claim 1, wherein resuming drilling comprises drilling through the blow-out preventer.

7. The process according to claim 1, the drilling vessel leaving the drilling location between drilling of the top hole part and drilling the lower part of the well.

8. The process according to claim 1, wherein the winter season comprises a period of the calendar year when ice concentration at the drilling location is at least 3/10.

9. The process according to claim 1, wherein the winter season comprises a period of the calendar year when ice thickness exceeds 0.1 m.

10. The process according to claim 1, wherein the winter season starts after 1 October.

11. The process according to claim 1, wherein the off-winter season starts when ice concentration at the drilling location is below 4/10.

12. The process according to claim 1, wherein drilling the top hole part and drilling the lower part of the well are performed by the same drilling vessel.

13. The process according to claim 1, further comprising mooring the drilling vessel at the offshore drilling location with a first number of anchor lines prior to the drilling of the top hole part, and, prior to resuming drilling the lower part of the well, mooring the drilling vessel at the offshore drilling location with a second number of anchor lines, the first number of anchor lines being smaller than the second number of anchor lines.

14. A process for drilling a plurality of wells into a hydrocarbon-bearing formation below the seafloor, comprising:

from a drilling vessel during a single winter season when water is at least partly covered by ice, drilling a top hole part for each of the plurality of wells to a depth above the hydrocarbon-bearing formation;

during a subsequent off-winter season when the water is less ice-infested than during the winter season, drilling a lower part of the well, for each of the plurality of wells, from the depth of the top hole part and extending into the hydrocarbon-bearing formation; and mooring the drilling vessel at offshore drilling locations with a first number of anchor lines prior to the drilling of the top hole part for each of the plurality of wells, and, prior to drilling the lower part for each of the plurality of wells, mooring the drilling vessel at the offshore drilling locations with a second number of anchor lines, the first number of anchor lines being smaller than the second number of anchor lines.

15. The process according to claim 14, further comprising, upon completion of the top hole part for each well of the plurality of wells, covering the well with a removable cover or lid until drilling resumes.

16. The process according to claim 14, wherein, for each of the plurality of wells, drilling the top hole part of the well comprises drilling through a blow-out-preventer.

17. The process according to claim 16, further comprising, for each of the plurality of wells, establishing a mud cellar or a caisson and deploying the blow-out preventer prior to drilling through the blow-out preventer.

18. The process according to claim 14, wherein drilling the top hole part for each of the plurality of wells comprises mooring the drilling vessel at a first drilling location that allows drilling of the top hole during the winter season.

19. The process according to claim 18, further comprising, between drilling of sequential wells, repositioning the drilling vessel to and mooring the drilling vessel at a second drilling location that allows drilling of the top hole part of a next well of the plurality of wells.

20. A process according to claim 19, further comprising laying out one or more anchor lines to moor the drilling vessel at the second drilling location prior to completing drilling the top hole part at the first drilling location.

21. A process according to claim 20, further comprising using at least one anchor line to moor the drilling vessel at the first drilling location and to subsequently moor the drilling vessel at the second drilling location.

22. A process according to claim 21, wherein repositioning of the vessel is performed while at least one anchor line remains connected to the drilling vessel.

23. A process for drilling a well into a hydrocarbon-bearing formation below the seafloor at an offshore drilling location, the process comprising:

from a drilling vessel, drilling a top hole part of the well during a winter season to a depth above the hydrocarbon-bearing formation during a time when water at the drilling location is at least partly covered by ice;

interrupting the drilling at the depth to reduce risk of hydrocarbons spilling into the water while the water is at least partly covered by ice;

resuming drilling into a lower part of the well from the depth and extending into the hydrocarbon-bearing formation during a subsequent off-winter season where the water is less ice-infested than during the winter season; and covering the top hole part of the well upon completion with a removable lid until drilling resumes.

24. The process according to claim 23, further comprising inserting one or both of a casing and conductor into the top hole part after or during the step of drilling the top hole part but before the step of interrupting.

25. The process according to claim 24, further comprising cementing one or both of the casing and conductor in the top hole part of the well.

26. The process according to claim 24, further comprising completing the drilling of the lower part during the subsequent off-winter season.

27. The process according to claim 23, the drilling vessel leaving the drilling location between drilling of the top hole part and drilling the lower part of the well.

28. The process according to claim 23, wherein the winter season comprises a period of the calendar year when ice thickness exceeds 0.1 m.

29. The process according to claim 23, wherein the winter season starts after 1 October.

30. The process according to claim 23, wherein the off-winter season starts when ice concentration at the drilling location is below 4/10.

31. The process according to claim 23, wherein drilling the top hole part and drilling the lower part of the well are performed by the same drilling vessel.

32. A process for drilling a plurality of wells into a hydrocarbon-bearing formation below the seafloor, comprising:

from a drilling vessel during a single winter season when water is at least partly covered by ice, drilling a top hole part for each of the plurality of wells to a depth above the hydrocarbon-bearing formation, wherein drilling the top hole part for each of the plurality of wells comprises mooring the drilling vessel at a first drilling location that allows drilling of the top hole during the winter season;

during a subsequent off-winter season when the water is less ice-infested than during the winter season, drilling a lower part of the well, for each of the plurality of wells, from the depth of the top hole part and extending into the hydrocarbon-bearing formation; and between drilling of sequential wells, repositioning the drilling vessel to and mooring the drilling vessel at a second drilling location that allows drilling of the top hole part of a next well of the plurality of wells.

33. The process according to claim 32, further comprising, upon completion of the top hole part for each well of the plurality of wells, covering the well with a removable cover or lid until drilling resumes.

34. The process according to claim 32, wherein, for each of the plurality of wells, drilling the top hole part of the well comprises drilling through a blow-out-preventer.

35. The process according to claim 34, further comprising, for each of the plurality of wells, establishing a mud cellar or caisson and deploying the blow-out preventer prior to drilling through the blow-out preventer.

36. A process according to claim 35, further comprising laying out one or more anchor lines to moor the drilling vessel at the second drilling location prior to completing drilling the top hole part at the first drilling location.

37. A process according to claim 36, further comprising using at least one anchor line to moor the drilling vessel at the first drilling location and to subsequently moor the drilling vessel at the second drilling location.

38. A process according to claim 37, wherein repositioning of the vessel is performed while at least one anchor line remains connected to the drilling vessel.

* * * * *